US011647320B2

(12) United States Patent
Zhu et al.

(10) Patent No.: US 11,647,320 B2
(45) Date of Patent: May 9, 2023

(54) ELASTOMER SLEEVE FOR WIRELESS EARPHONE AND WIRELESS EARPHONE

(71) Applicant: Harman International Industries, Incorporated, Stamford, CT (US)

(72) Inventors: Yongsheng Zhu, Shenzhen (CN); Linyong Fan, Shenzhen (CN); Florin Negrut, Novi, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 1 day.

(21) Appl. No.: 17/375,583

(22) Filed: Jul. 14, 2021

(65) Prior Publication Data

US 2022/0021961 A1 Jan. 20, 2022

(30) Foreign Application Priority Data

Jul. 16, 2020 (CN) ..... 202010684460.6

(51) Int. Cl.
*H04R 1/10* (2006.01)

(52) U.S. Cl.
CPC ..... *H04R 1/1016* (2013.01); *H04R 2420/07* (2013.01)

(58) Field of Classification Search
CPC ..... H04R 1/1016; H04R 2420/07; H04R 2225/51; H04R 1/1091; H01Q 1/22
See application file for complete search history.

(56) References Cited

U.S. PATENT DOCUMENTS

| | | | | |
|---|---|---|---|---|
| 9,736,569 | B2 * | 8/2017 | Kelly | H04R 25/652 |
| 2008/0119138 | A1 * | 5/2008 | Kim | H04M 1/05 455/575.2 |
| 2014/0153768 | A1 * | 6/2014 | Hagen | H04R 1/1008 381/380 |
| 2016/0249133 | A1 * | 8/2016 | Sørensen | H04R 1/1066 |
| 2017/0195770 | A1 * | 7/2017 | Cheney | H04R 1/1016 |
| 2017/0339479 | A1 * | 11/2017 | Levine | H04R 1/1016 |
| 2017/0359644 | A1 * | 12/2017 | Cramer | H04R 1/1008 |
| 2018/0035196 | A1 * | 2/2018 | Yeung | H04R 1/1058 |
| 2018/0332379 | A1 * | 11/2018 | McGarry | H04R 1/1058 |
| 2019/0200112 | A1 * | 6/2019 | Briggs | H04R 1/105 |
| 2020/0021905 | A1 * | 1/2020 | Briggs | H04R 1/1066 |
| 2021/0281939 | A1 * | 9/2021 | Yuen | H04R 1/105 |

FOREIGN PATENT DOCUMENTS

| | | | | |
|---|---|---|---|---|
| CN | 207802296 U | * | 8/2018 | H04R 1/10 |
| CN | 209517448 U | * | 10/2019 | H04R 1/10 |
| WO | WO-2014088224 A1 | * | 6/2014 | H01Q 1/2291 |

* cited by examiner

*Primary Examiner* — Oyesola C Ojo
(74) *Attorney, Agent, or Firm* — McCoy Russell LLP

(57) ABSTRACT

Disclosed are an elastomer sleeve for a wireless earphone and a wireless earphone. The elastomer sleeve for the wireless earphone includes: a sleeve body defining a space for accommodating an earphone body of the wireless earphone; a sleeve wing portion formed integrally with the sleeve body and extending outward from the sleeve body; and an antenna formed in the elastomer sleeve and extending from the sleeve body to the sleeve wing portion. The wireless earphone includes an earphone body and one or more elastomer sleeves for detachably connecting to the earphone body and partially enclosing the earphone body.

18 Claims, 9 Drawing Sheets

ELASTOMER SLEEVE FOR WIRELESS EARPHONE AND WIRELESS EARPHONE

CROSS REFERENCE TO RELATED APPLICATIONS

The present application claims priority to Chinese Patent Application No. 202010684460.6, entitled "An Elastomer Sleeve For A Wireless Earphone And A Wireless Earphone," and filed Jul. 16, 2020. The entire contents of the above-listed application are hereby incorporated by reference for all purposes.

TECHNICAL FIELD

The present disclosure relates to an elastomer sleeve for a wireless earphone and a wireless earphone including the elastomer sleeve.

BACKGROUND ART

Wireless earphones are becoming more and more popular due to their portability and convenience. Wireless earphones need to be as small as possible to meet ergonomic requirements. At the same time, wireless earphones include many components, such as electronic components, metal components, batteries, and the like. How to reasonably arrange many components of a wireless earphone in a small earphone shell has always been a difficult problem in the design of wireless earphones.

An antenna is one of the key components of a wireless earphone and is used to receive and transmit RF (e.g., radio frequency) signals. A good antenna design requires free space. The more the free space, the better the performance (e.g., RF efficiency). However, the size of earphones becomes increasingly small along with the requirements for comfortable wearing and good ergonomic performance. The space in an earphone becomes more limited, which consequently leads to increasingly strict constraints for the antenna design of wireless earphones.

In addition, the outer ear of a wearer of a wireless earphone absorbs radio frequency energy, which results in a loss of 3-6 dB. A smaller earphone enters deeper into an ear canal, and the earphone is closer to the human body and more energy will be absorbed.

Therefore, there is a need for a new earphone antenna design, which can improve the earphone antenna performance while satisfying the requirement that wireless earphones are as small as possible.

SUMMARY

The present disclosure provides a new earphone antenna design, which can satisfy the requirement that the wireless earphone is as small as possible and provide the earphone antenna with a large free space, thereby improving the earphone antenna performance.

According to one aspect of the present disclosure, an elastomer sleeve for a wireless earphone is provided, the elastomer sleeve including: a sleeve body defining a space for accommodating an earphone body of the wireless earphone; a sleeve wing portion formed integrally with the sleeve body and extending outward from the sleeve body; and an antenna formed in the elastomer sleeve and extending from the sleeve body to the sleeve wing portion.

Optionally, the antenna includes a connecting portion formed in the sleeve body and connected to the antenna, the earphone body includes a connecting portion connected to the PCB (e.g., printed circuit board) of the earphone body, and the connecting portion of the antenna is used for connection with the connecting portion of the earphone body.

Optionally, the elastomer sleeve includes a magnet connected to its connecting portion, and the magnet facilitates the connection between the connecting portion of the antenna and the connecting portion of the earphone body.

Optionally, the elastomer sleeve and the earphone body each include a magnet connected to its connecting portion, and the magnet facilitates the connection between the connecting portion of the antenna and the connecting portion of the earphone body.

Optionally, the connecting portion of the antenna and the connecting portion of the earphone body are both L-shaped plates including a bottom plate and a side plate, and when the elastomer sleeve is connected to the earphone body, the bottom plate of the connecting portion of the antenna and the bottom plate of the connecting portion of the earphone body abut against each other and are sandwiched between the magnet of the elastomer sleeve and the magnet of the earphone body.

Optionally, the connecting portion of the antenna and the connecting portion of the earphone body are both flat plates, and when the elastomer sleeve is connected to the earphone body, the connecting portion of the antenna and the connecting portion of the earphone body abut against each other and are sandwiched between the magnet of the elastomer sleeve and the magnet of the earphone body.

Optionally, the antenna is a metal wire antenna or an FPC (e.g., flexible printed circuit) antenna.

Optionally, the metal wire antenna is linear or helical.

Optionally, the antenna extends along most of the length of the sleeve wing portion.

Optionally, the elastomer sleeve includes an elastomer body formed to coat the antenna.

Optionally, the elastomer sleeve is a silicone gel sleeve.

Optionally, the connecting portion is exposed to the space from the elastomer sleeve.

According to another aspect of the present disclosure, a wireless earphone is provided, including an earphone body and one or more of the above elastomer sleeves, wherein the elastomer sleeve is used for detachable connection to the earphone body and partially enclosing the earphone body.

Optionally, a plurality of the elastomer sleeves have different sizes.

Optionally, the wireless earphone is a Bluetooth earphone.

Optionally, the elastomer sleeve and the earphone body each include a magnet connected to its connecting portion, and the magnet facilitates the connection between the connecting portion of the antenna and the connecting portion of the earphone body.

Optionally, the connecting portion of the antenna and the connecting portion of the earphone body are both L-shaped plates including a bottom plate and a side plate, and when the elastomer sleeve is connected to the earphone body, the bottom plate of the connecting portion of the antenna and the bottom plate of the connecting portion of the earphone body abut against each other and are sandwiched between the magnet of the elastomer sleeve and the magnet of the earphone body.

Optionally, the connecting portion of the antenna is welded to the antenna, and the magnet of the elastomer sleeve is bonded to the connecting portion of the antenna.

Optionally, the connecting portion of the earphone body is welded to the PCB of the earphone body, and the magnet of the earphone body is bonded to the connecting portion of the earphone body.

DESCRIPTION OF THE DRAWINGS

FIGS. 2 and 3 show bottom views of the wireless earphone of FIG. 1, wherein FIG. 2 shows an antenna formed in the elastomer sleeve, and FIG. 3 shows the antenna in the elastomer sleeve and a PCB in the earphone body;

DETAILED DESCRIPTION

Figure 1:
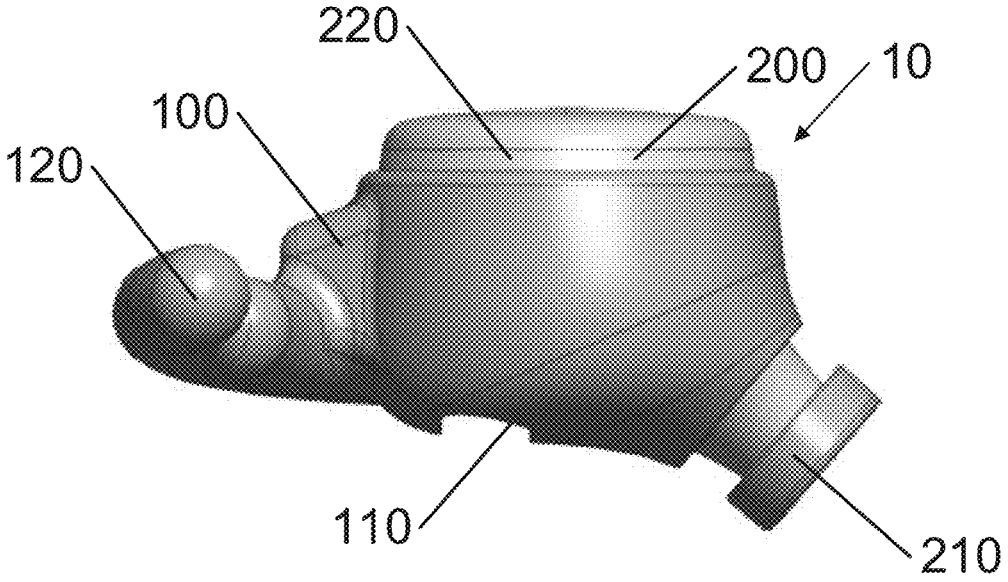
FIG. 1 shows a perspective view of a wireless earphone according to one or more embodiments of the present disclosure.

Embodiments of the present disclosure will be described in detail below. Examples of the embodiments are shown in the accompanying drawings, wherein the same or similar reference numerals always indicate the same or similar elements or elements with the same or similar functions. The embodiments described below with reference to the accompanying drawings are illustrative, which are only used to explain the present disclosure, and cannot be construed as limitations to the present disclosure.

Unless otherwise defined, the technical terms or scientific terms used here should have the ordinary meanings understood by those of ordinary skill in the field of the present disclosure. In the description of the present disclosure, it should be understood that an orientation or positional relationship indicated by the terms "center," "longitudinal," "lateral," "upper," "lower," "front," "back," "left," "right," "vertical," "horizontal," "top," "bottom," "inner," "outer," etc. is an orientation or positional relationship shown based on the accompanying drawings, and is only for the convenience of describing the present disclosure and simplifying the description, rather than indicating or implying that a device or element referred to must have a specific orientation or be constructed and operated in a specific orientation, and thus cannot be understood as a limitation to the present disclosure. In addition, the terms "first" and "second" are only used for descriptive purposes, and cannot be understood as indicating or implying relative importance.

FIG. 1 shows a wireless earphone 10 according to one or more embodiments of the present disclosure. The wireless earphone 10 includes an earphone body 200 and an elastomer sleeve 100 connected to the earphone body 200. The earphone body 200 includes a body front 210 and a body rear 220. An earmuff (not shown) is usually installed on the body front 210 of the earphone. At the wearing position of the earphone, the body front 210 is at least partially located in the ear canal of a wearer, and (at least most of) the body rear 220 is located outside the ear canal of the wearer. The elastomer sleeve 100 partially coats the body rear 220, and includes a sleeve body 110 and a sleeve wing portion 120 formed integrally with the sleeve body 110 and extending outward from the sleeve body. At the wearing position of the earphone, the sleeve wing portion 120 is placed at a suitable position in an auricle for interacting with the auricle to help fix the position of the earphone.

Figure 2:
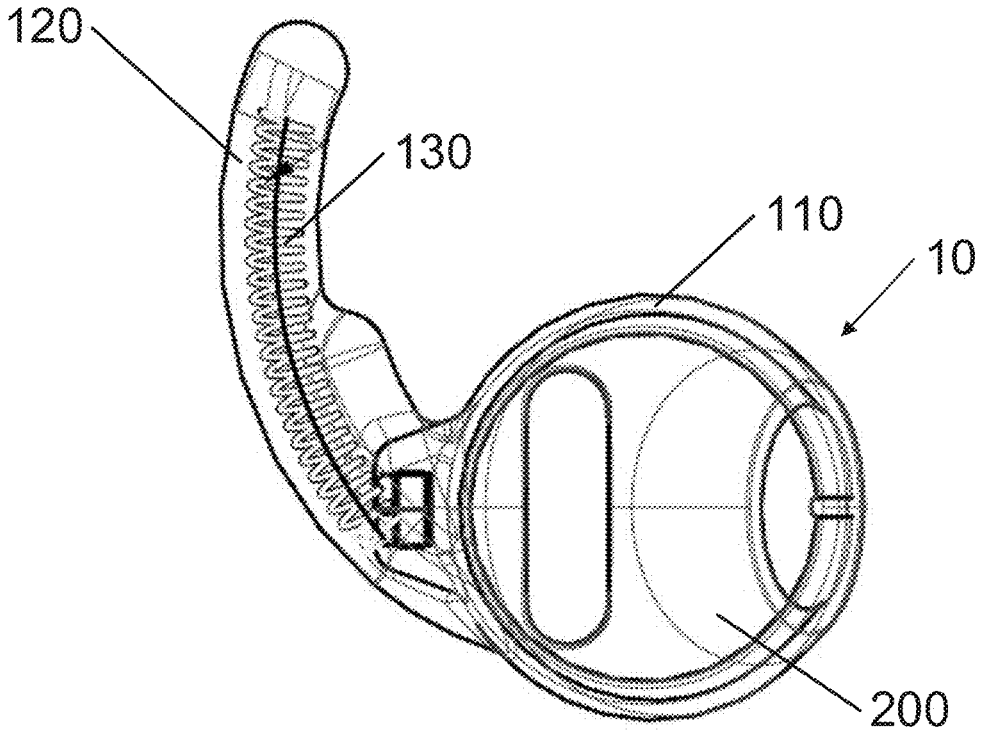
Figure 3:
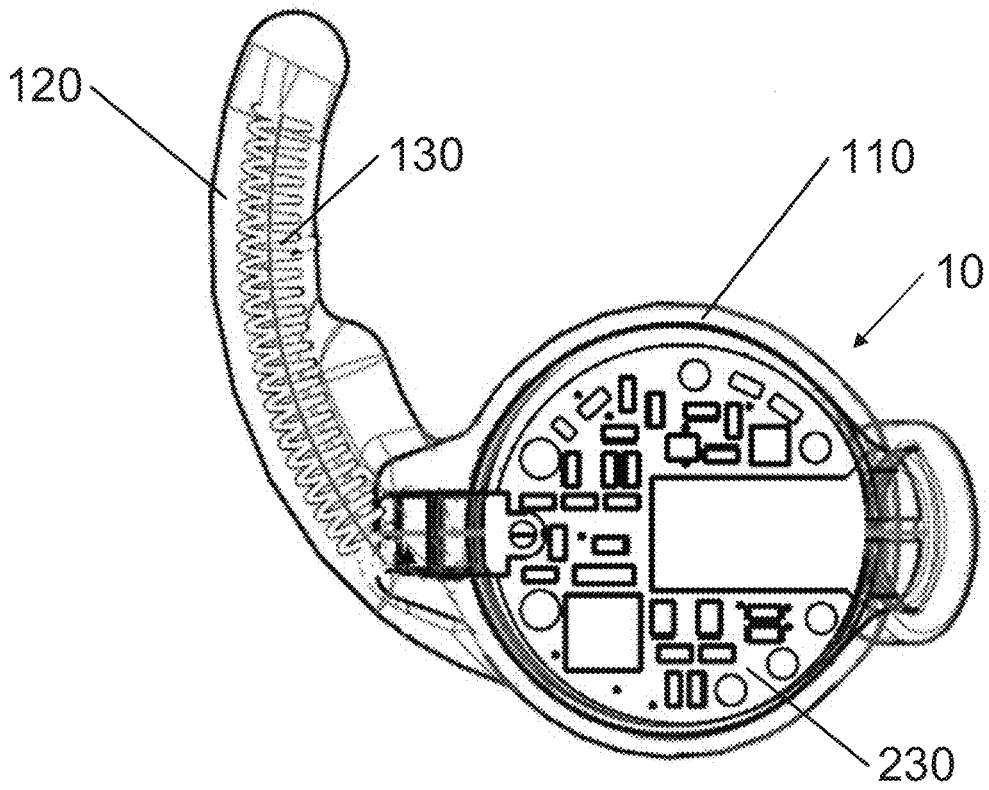

FIGS. 2 and 3 show bottom views of the wireless earphone 10, wherein FIG. 2 shows an antenna 130 formed in the elastomer sleeve, and FIG. 3 shows the antenna 130 in the elastomer sleeve and a PCB 230 in the earphone body 200.

Figure 4:
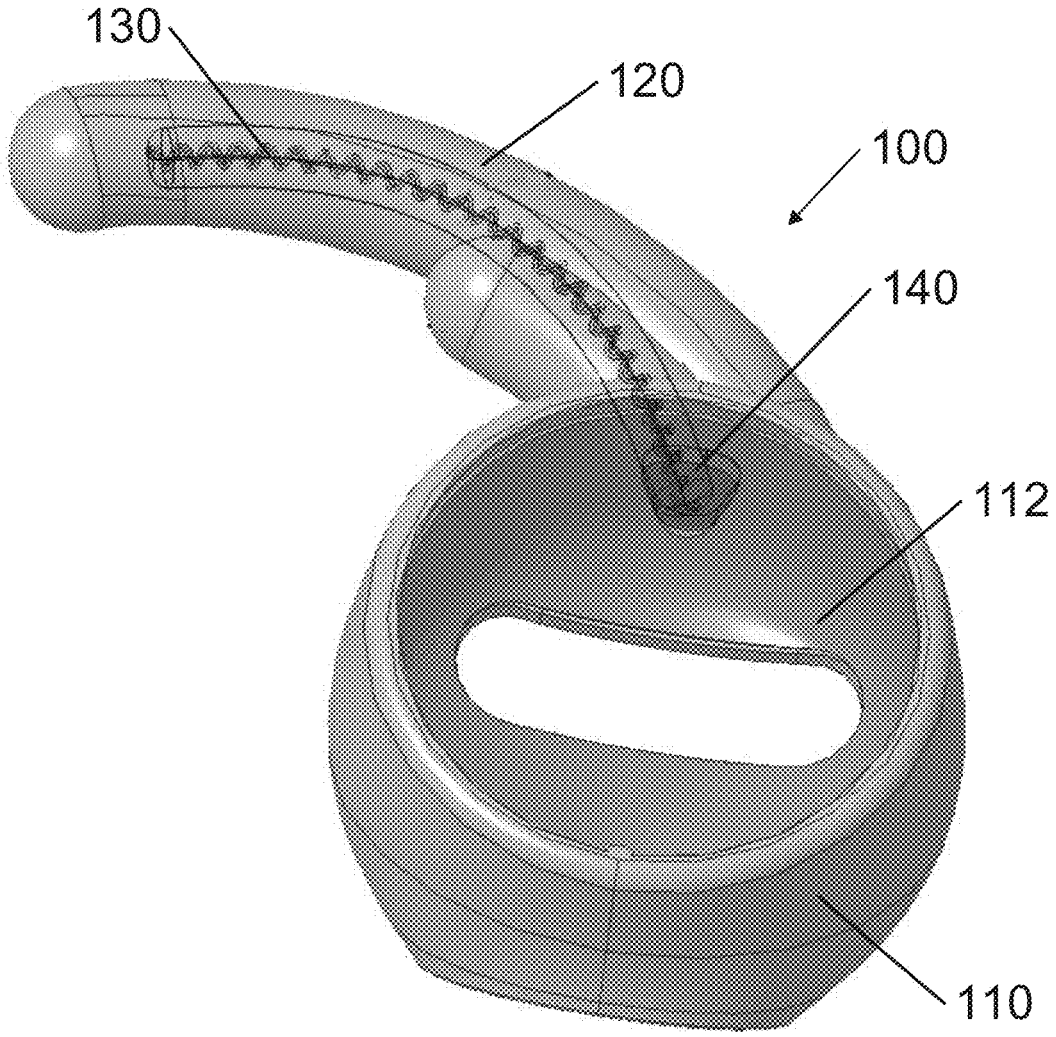
FIG. 4 shows a perspective view of the elastomer sleeve.

FIG. 4 shows the elastomer sleeve 100. As shown in FIG. 4, the elastomer sleeve 100 includes the sleeve body 110, the sleeve body 110 defining a space 112 for accommodating the earphone body 200. When the elastomer sleeve 100 is connected to the earphone body, the earphone body (e.g., the earphone rear) is in the space defined by the sleeve body 110. The sleeve wing portion 120 is formed integrally with the sleeve body 110 and extends outward from the sleeve body 110. The antenna 130 is formed in the elastomer sleeve 100, and one end of the antenna 130 includes a connecting portion 140. As can be clearly seen in FIG. 4, the connecting portion 140 is exposed to the space 112 from the sleeve body 110. The antenna 130 extends from the connecting portion 140 along the length direction of the sleeve wing portion 120 to near a free end of the sleeve wing portion 120. Most of the length of the antenna 130 is inside the sleeve wing portion 120.

Figure 5:
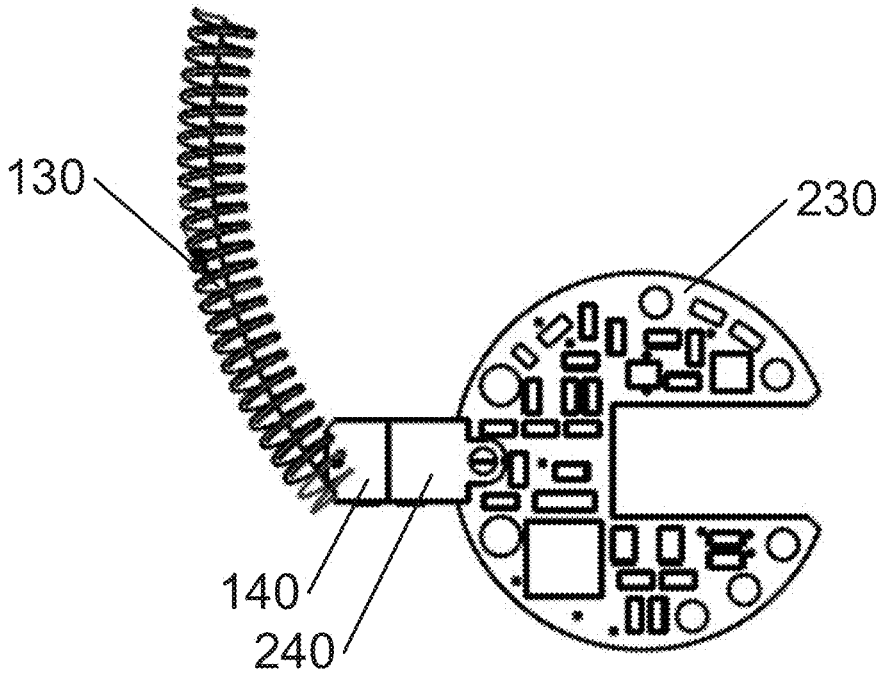
FIGS. 5 and 6 show the connection between the antenna in the elastomer sleeve and the PCB of the earphone body, wherein the elastomer part of the elastomer sleeve and the shell of the earphone body are not shown for the purpose of clarity.
Figure 6:
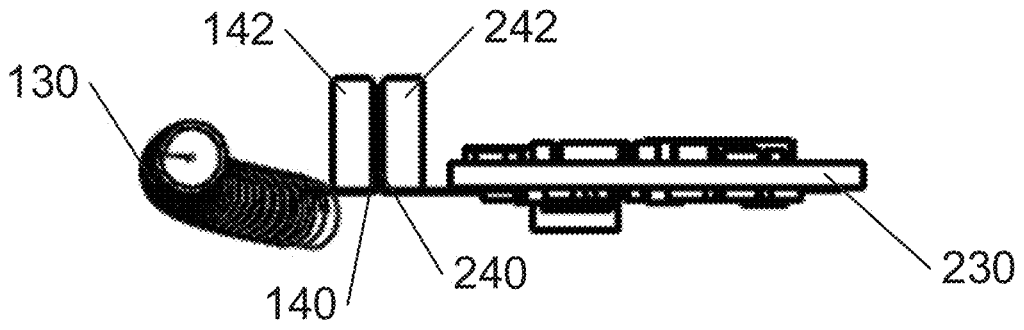

FIGS. 5 and 6 show the connection between the antenna 130 and the PCB of the earphone body. For the sake of clarity, the elastomer part of the elastomer sleeve 100, the shell of the earphone body, etc. are not shown. As shown in the figures, the proximal end of the antenna 130 is the connecting portion 140, and a connecting portion 240 is provided at a position corresponding to the connecting portion 140 on the PCB 230. In some embodiments of the present disclosure, the connecting portion 140 is welded to the antenna 130, and the connecting portion 240 is welded to the PCB 230 of the earphone body. When the elastomer sleeve 100 is connected to the earphone body 200, the connecting portion 140 of the antenna 130 abuts the connecting portion 240 connected to the PCB 230, so that the antenna 130 is connected to the PCB 230.

As shown in FIG. 6, in some embodiments of the present disclosure, the elastomer sleeve 100 includes a magnet 142 connected to the connecting portion 140, and the earphone body 200 includes a magnet 242 connected to the connecting portion 240. The magnet 142 and the magnet 242 facilitate the connection and alignment of the connecting portion 140 and the connecting portion 240.

Figure 7:
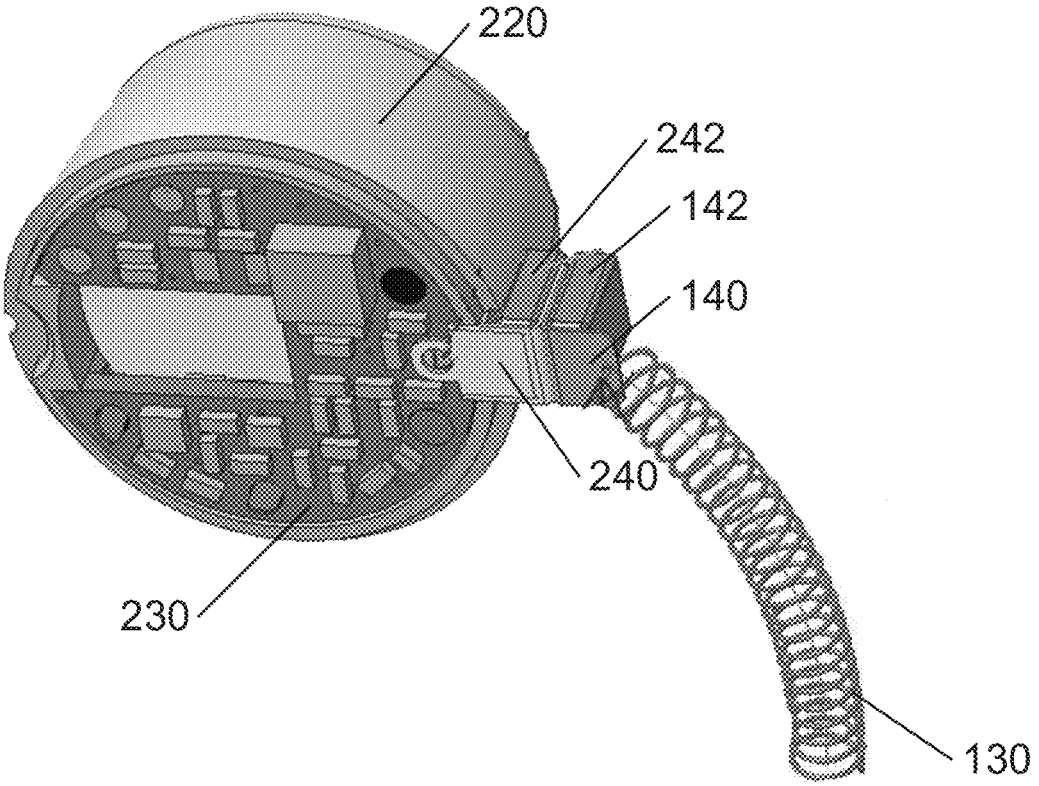
FIG. 7 is a perspective view of an earphone according to one or more embodiments of the present disclosure, showing the connection between the antenna and the earphone body, wherein the elastomer of the elastomer sleeve and the shell of the earphone body are not shown for the purpose of clarity.

FIG. 7 is a perspective view of the earphone 10 according to the present disclosure, showing the connection between an antenna and an earphone body, wherein the elastomer of the elastomer sleeve 100 and the shell of the earphone body are not shown for the purpose of clarity.

Figure 8:
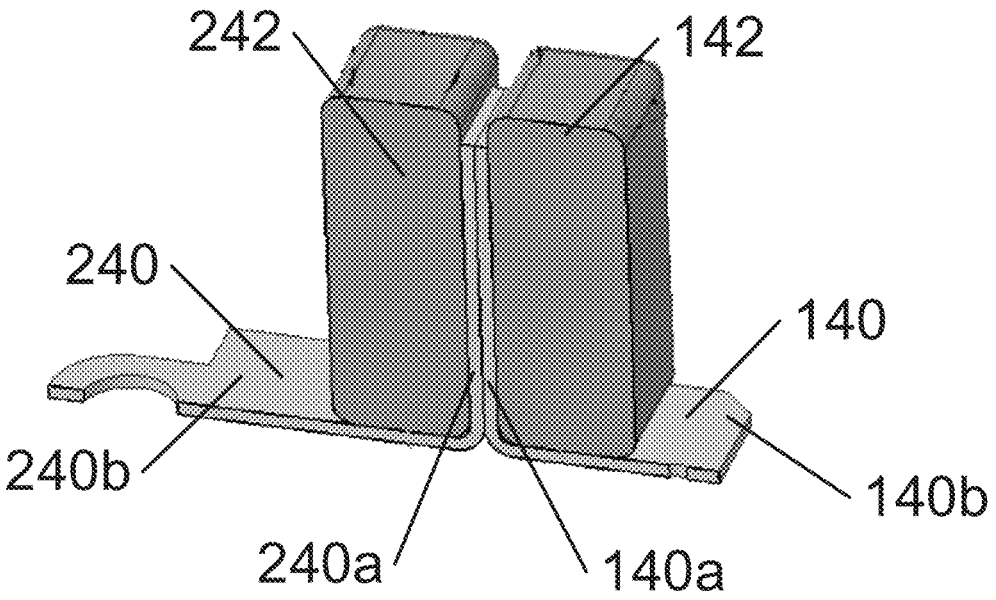
FIGS. 8 and 9 show enlarged views of a connection between a connecting portion of the antenna and a connecting portion of the earphone body.
Figure 9:
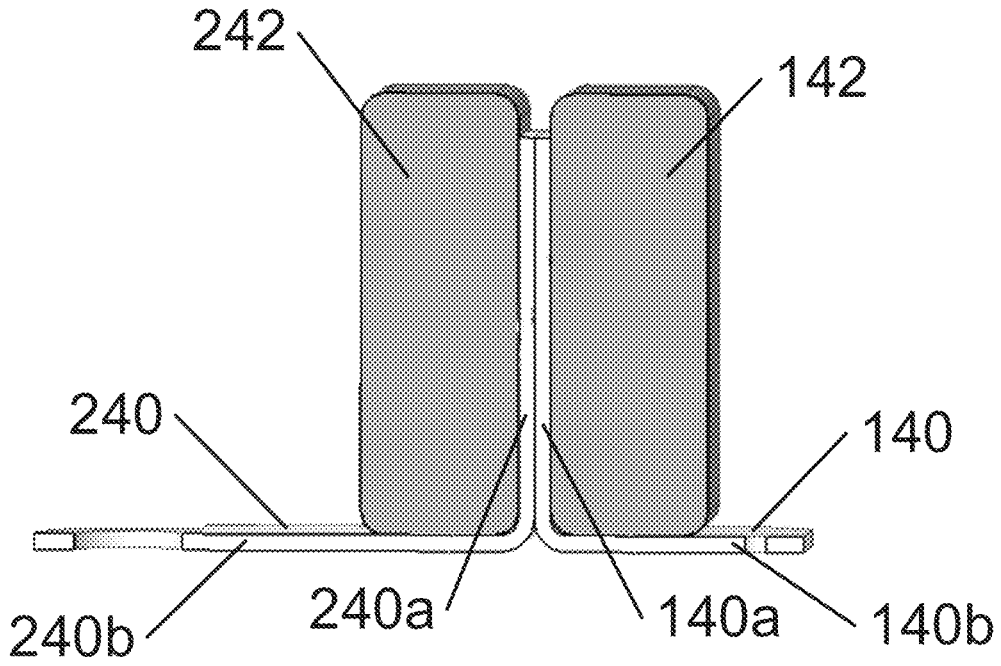

FIGS. 8 and 9 show enlarged views of the connection between the connecting portion 140 of the antenna and the connecting portion 240 of the earphone body. As shown in FIGS. 8 and 9, the connecting portion 140 is a plate with an L-shaped cross section and including a bottom plate 140*a* and a side plate 140*b*. The magnet 142 is placed in a space defined by the bottom plate 140*a* and the side plate 140*b* of the connecting portion 140. One bottom side and one side of the magnet 142 abut against the bottom plate 140*a* and the side plate 140*b* of the connecting portion 140, respectively, and are bonded to the bottom plate 140*a* and the side plate 140*b* by an adhesive, thereby fixing the magnet 142 to the connecting portion 140. The connecting portion 240 is a plate with an L-shaped cross section and including a bottom plate 240*a* and a side plate 240*b*. The magnet 242 is placed in a space defined by the bottom plate 240*a* and the side plate 240*b* of the connecting portion 240. One bottom side and one side of the magnet 242 abut against the bottom plate 240*a* and the side plate 240*b* of the connecting portion 240, respectively, and are bonded to the bottom plate 240*a* and the side plate 240*b* by an adhesive, thereby fixing the magnet 242 to the connecting portion 240.

When the elastomer sleeve 100 is connected to the earphone body 200, the bottom plate 140*a* of the connecting portion 140 and the bottom plate 240*a* of the connecting portion 240 abut against each other, and the bottom plate 140*a* of the connecting portion 140 and the bottom plate 240*a* of the connecting portion 240 are sandwiched between the magnet 142 and the magnet 242. A magnetic force between the magnet 142 and the magnet 242 facilitates a firm connection and accurate positioning between the connecting portion 140 and the connecting portion 240.

With regard to antenna designs of wireless earphones, a good antenna design requires free space. The more the free space, the better the performance. In addition, when the antenna length is approximately ¼ of a signal wavelength, the antenna performance is optimal. As shown in FIGS. 2, 3, 5, and 7, by arranging the antenna of the wireless earphone in the elastomer sleeve 100 and setting the antenna of the wireless earphone outside the earphone shell, the design and size of the antenna are no longer limited by the earphone shell with a small size. In this way, the antenna of the wireless earphone can obtain a large free space, and can easily achieve a length of ¼ wavelength, so that the optimal antenna performance can be achieved.

In addition, the earphone antenna of the present disclosure is arranged in the elastomer sleeve of the earphone. Compared with solutions in which the antenna is in the earphone shell or on the earphone shell, the earphone antenna according to the present disclosure is far away from the ear canal and the human body, so that signals are not interfered with and affected by the human body, and the earphone antenna performance is further improved.

Generally, the elastomer sleeve is detachably connected to the earphone body for replacement. The present disclosure adopts the form of the L-shaped connecting portion with a magnet, which can ensure that the connecting portion of the elastomer sleeve and the connecting portion of the earphone body are quickly connected and accurately positioned when the elastomer sleeve is detachably connected to the earphone body, and at the same time, it is ensured that the connecting portion of the elastomer sleeve is firmly connected to the connecting portion of the earphone body, thereby ensuring that the antenna in the elastomer sleeve can be quickly, accurately, and firmly connected to the PCB in the earphone body.

In the description above, the present disclosure is described in conjunction with a helical antenna. However, the present disclosure is not limited to this. Any other suitable antennas, such as linear antennas or FPC antennas, can also be used in the present disclosure. A linear antenna is simple to manufacture and has low cost, while a helical antenna or FPC antenna has the advantage of a large equivalent length. In some embodiments, the present disclosure uses different forms of antennas for elastomer sleeves of different sizes to achieve the optimal antenna performance. For example, wireless earphones usually come with several pairs of elastomer sleeves, such as three pairs of large, medium, and small elastomer sleeves, or four or five pairs of elastomer sleeves from large to small, so that they can be better applicable to different people. In some embodiments of the present disclosure, a relatively large elastomer sleeve adopts a linear antenna to achieve the best length of ¼ signal wavelength, while a relatively small elastomer sleeve adopts a helical antenna and an FPC antenna to achieve an effective length of ¼ signal wavelength. For example, for three pairs of elastomer sleeves of large, medium, and small sizes, in some embodiments, the large elastomer sleeve adopts a linear antenna, and the small elastomer sleeve adopts a helical antenna and an FPC antenna.

In some embodiments of the present disclosure, the antenna is formed in the elastomer sleeve by means of overmolding. However, the present disclosure is not limited to this, and other suitable processes known in the art can be used to form the antenna in the elastomer sleeve. In some embodiments of the present disclosure, the material of the elastomer sleeve is a silicone gel, but the present disclosure is not limited to this. Other suitable elastomer materials known in the art can be used. By overmolding of the antenna with an elastomer, the contact between the antenna and a wearer's skin can be avoided, which enhances the antenna performance.

In some embodiments of the present disclosure, both the elastomer sleeve and the earphone body adopt L-shaped connecting portions and magnets. However, the present disclosure is not limited to this, and the connecting portions of the elastomer sleeve and the earphone body may be a flat connecting portion. When the elastomer sleeve is connected to the earphone body, the flat connecting portion of the elastomer sleeve and the flat connecting portion of the earphone body abut against each other, and the flat connecting portion of the elastomer sleeve and the flat connecting portion of the earphone body are sandwiched between the magnet of the elastomer sleeve and the magnet of the earphone body. In alternative embodiments, one of the connecting portion of the elastomer sleeve and the connecting portion of the earphone body is an L-shaped plate, and the other is a flat plate. In alternative embodiments, only one of the elastomer sleeve and the earphone body has a magnet connected to the connecting portion. In other alternative embodiments, neither the elastomer sleeve nor the earphone body has a magnet connected to the connecting portion. In this case, a firm connection between the connecting portion of the elastomer sleeve and the connecting portion of the earphone body is mainly achieved by the elasticity of the elastomer sleeve. In alternative embodiments, the connecting portion of the earphone body may be recessed relative to the earphone body, and the connecting portion of the elastomer sleeve protrudes, thereby facilitating accurate positioning between the connecting portion of the earphone body and the connecting portion of the elastomer sleeve.

The depicted embodiment of the present disclosure shows an in-ear earphone, but the present disclosure is not limited to this. The present disclosure may adopt other suitable forms of earphones, such as semi-in-ear earphones or earbud earphones.

The depicted embodiment of the present disclosure shows a Bluetooth earphone, but the present disclosure is not limited to this. The present disclosure may incorporate other wireless earphones that require an antenna, such as infrared earphones.

In addition, in some embodiments, the contact surface between the connecting portion of the elastomer sleeve and the connecting portion of the earphone body may be plated with silver or gold to enhance the electrical connection therebetween.

The foregoing descriptions are merely example embodiments adopted to illustrate the principles of the present disclosure, and are not used to limit the protection scope of the present disclosure. For those of ordinary skill in the art, various modifications and improvements can be made without departing from the spirit and essence of the present disclosure, and these modifications and improvements are also within the protection scope of the present disclosure.

The invention claimed is:

1. An elastomer sleeve for a wireless earphone, including:

a sleeve body defining a space for accommodating an earphone body of the wireless earphone;

a sleeve wing portion formed integrally with the sleeve body and extending outward from the sleeve body; and an antenna formed in the elastomer sleeve and extending from the sleeve body to the sleeve wing portion, wherein the elastomer sleeve includes a connecting portion formed in the sleeve body at an end of the antenna, the earphone body includes a connecting portion connected to a PCB of the earphone body, and the connecting portion of the elastomer sleeve is operable to connect with the connecting portion of the earphone body to form an electrical connection therebetween.

2. The elastomer sleeve according to claim 1, wherein the elastomer sleeve includes a magnet connected to its connecting portion, and the magnet facilitates the connection between the connecting portion of the elastomer sleeve and the connecting portion of the earphone body.

3. The elastomer sleeve according to claim 1, wherein the elastomer sleeve and the earphone body each include a magnet connected to its connecting portion that facilitates the connection between the connecting portion of the elastomer sleeve and the connecting portion of the earphone body.

4. The elastomer sleeve according to claim 3, wherein the connecting portion of the elastomer sleeve and the connecting portion of the earphone body are both L-shaped plates including a bottom plate and a side plate, and when the elastomer sleeve is connected to the earphone body, the bottom plate of the connecting portion of the elastomer sleeve and the bottom plate of the connecting portion of the earphone body abut against each other and are sandwiched between the magnet of the elastomer sleeve and the magnet of the earphone body.

5. The elastomer sleeve according to claim 3, wherein the connecting portion of the elastomer sleeve and the connecting portion of the earphone body are both flat plates, and when the elastomer sleeve is connected to the earphone body, the connecting portion of the elastomer sleeve and the connecting portion of the earphone body abut against each other and are sandwiched between the magnet of the elastomer sleeve and the magnet of the earphone body.

6. The elastomer sleeve according to claim 1, wherein the antenna includes an antenna selected from: a metal wire antenna, and an FPC antenna.

7. The elastomer sleeve according to claim 6, wherein the metal wire antenna includes an antenna selected from: a linear antenna, and a helical antenna.

8. The elastomer sleeve according to claim 1, wherein the antenna extends along most of a length of the sleeve wing portion.

9. The elastomer sleeve according to claim 1, wherein the elastomer sleeve includes an elastomer body formed to coat the antenna.

10. The elastomer sleeve according to claim 1, wherein the elastomer sleeve includes a silicone gel sleeve.

11. The elastomer sleeve according to claim 1, wherein the connecting portion of the elastomer sleeve is exposed to the space of the sleeve body.

12. A wireless earphone including an earphone body and one or more elastomer sleeves according to claim 1, wherein the elastomer sleeve is operable to be detachably connected to the earphone body and to partially enclose the earphone body.

13. The wireless earphone according to claim 12, wherein a plurality of the elastomer sleeves have different sizes.

14. The wireless earphone according to claim 12, wherein the wireless earphone includes a Bluetooth earphone.

15. The wireless earphone according to claim 12, wherein the elastomer sleeve and the earphone body each include a magnet connected to its connecting portion, and the magnets facilitate the connection between the connecting portion of the elastomer sleeve and the connecting portion of the earphone body.

16. The wireless earphone according to claim 15, wherein the connecting portion of the elastomer sleeve and the connecting portion of the earphone body are both L-shaped plates including a bottom plate and a side plate, and when the elastomer sleeve is connected to the earphone body, the bottom plate of the connecting portion of the elastomer sleeve and the bottom plate of the connecting portion of the earphone body abut against each other and are sandwiched between the magnet of the elastomer sleeve and the magnet of the earphone body.

17. The wireless earphone according to claim 16, wherein the connecting portion of the elastomer sleeve is welded to the antenna, and the magnet of the elastomer sleeve is bonded to the connecting portion of the elastomer sleeve.

18. The wireless earphone according to claim 16, wherein the connecting portion of the earphone body is welded to a PCB of the earphone body, and the magnet of the earphone body is bonded to the connecting portion of the earphone body.

* * * * *